US008661863B2

(12) United States Patent
Loreti

(10) Patent No.: US 8,661,863 B2
(45) Date of Patent: Mar. 4, 2014

(54) PROGRAMMABLE CYLINDER LOCK HAVING A DEVICE FOR PROTECTION OF THE CODIFICATION, AND THE KEYS FOR THE OPERATION THEREOF

(75) Inventor: Alberto Loreti, Antrodoco (IT)

(73) Assignee: Rielda Serrature S.r.l., Fiumicino (Roma) (IT)

( * ) Notice: Subject to any disclaimer, the term of this patent is extended or adjusted under 35 U.S.C. 154(b) by 0 days.

(21) Appl. No.: 13/643,373

(22) PCT Filed: Apr. 13, 2011

(86) PCT No.: PCT/EP2011/001949

§ 371 (c)(1),
(2), (4) Date: Oct. 25, 2012

(87) PCT Pub. No.: WO2011/134610

PCT Pub. Date: Nov. 3, 2011

(65) Prior Publication Data

US 2013/0036782 A1 Feb. 14, 2013

(30) Foreign Application Priority Data

Apr. 27, 2010 (IT) ..... TO2010A0350

(51) Int. Cl.
*E05B 25/00* (2006.01)

(52) U.S. Cl.
USPC ..... 70/383; 70/495; 70/337; 70/492; 70/493

(58) Field of Classification Search
USPC ..... 70/492–496, 337, 340–343, 382–385
See application file for complete search history.

(56) References Cited

U.S. PATENT DOCUMENTS

| | | | | |
|---|---|---|---|---|
| 4,712,399 | A * | 12/1987 | Mattossovich | 70/495 |
| 4,966,021 | A * | 10/1990 | Boag | 70/383 |
| 6,119,495 | A * | 9/2000 | Loreti | 70/340 |
| 7,007,528 | B2 * | 3/2006 | Chong et al. | 70/492 |
| 7,424,815 | B1 * | 9/2008 | Pagnoncelli | 70/340 |
| 7,448,239 | B1 * | 11/2008 | Huang et al. | 70/360 |

(Continued)

FOREIGN PATENT DOCUMENTS

| | | |
|---|---|---|
| EP | 0 226 252 | 6/1987 |
| EP | 0 900 310 | 3/1999 |
| WO | 98/40589 | 9/1998 |

OTHER PUBLICATIONS

International Search Report dated Sep. 6, 2011, corresponding to PCT/EP2011/001949.

*Primary Examiner* — Suzanne Barrett
(74) *Attorney, Agent, or Firm* — Young & Thompson

(57) ABSTRACT

A programmable cylinder lock includes a stator and a cylindrical rotor, mounted therein for rotation around its own axis, has a keyhole, and comprising inside the rotor key followers movable along the longitudinal and transversal directions, and locking pins movable along the longitudinal direction, the followers and locking pins forming together a number of pairs and having toothings for mutually cooperating to define the lock codification, the rotor including a stop bar cooperating with a longitudinal groove of the stator and cooperating with the pins to immobilize them, and a change bar slidingly coupled with the followers to keep them engaged with the pins and to disengage them therefrom when the bar provides a lock programming position. The followers have a projection which engages a side surface of the key and, at the contact of a normal use key, prevents the transversal displacement of the key and the change bar.

5 Claims, 2 Drawing Sheets

(56) References Cited

U.S. PATENT DOCUMENTS

| | | | | |
|---|---|---|---|---|
| 7,448,240 | B1 * | 11/2008 | Huang et al. | 70/492 |
| 7,584,635 | B2 * | 9/2009 | Gan et al. | 70/338 |
| 7,624,606 | B1 * | 12/2009 | Huang et al. | 70/338 |
| 7,628,048 | B2 * | 12/2009 | Huang et al. | 70/338 |
| 7,836,739 | B2 * | 11/2010 | Huang et al. | 70/360 |
| 7,937,976 | B2 * | 5/2011 | Huang et al. | 70/338 |
| 7,980,104 | B1 * | 7/2011 | Huang | 70/338 |
| 8,074,480 | B2 * | 12/2011 | Huang et al. | 70/383 |
| 8,161,783 | B2 * | 4/2012 | Huang et al. | 70/492 |
| 8,448,484 | B2 * | 5/2013 | Huang et al. | 70/383 |
| 2005/0217330 | A1 | 10/2005 | Chong et al. | |
| 2007/0101782 | A1 * | 5/2007 | Shen | 70/495 |
| 2009/0277239 | A1 | 11/2009 | Mathachan | |
| 2012/0291505 | A1 * | 11/2012 | Loreti | 70/493 |
| 2012/0304716 | A1 * | 12/2012 | Loreti | 70/492 |
| 2012/0304717 | A1 * | 12/2012 | Loreti | 70/493 |
| 2013/0036782 | A1 * | 2/2013 | Loreti | 70/493 |

* cited by examiner

PROGRAMMABLE CYLINDER LOCK HAVING A DEVICE FOR PROTECTION OF THE CODIFICATION, AND THE KEYS FOR THE OPERATION THEREOF

BACKGROUND OF THE INVENTION

The subject of this invention is a programmable cylinder lock, namely a lock comprising devices intended to allow the initial codification of the lock or, through a change operation, to modify the former lock codification in order to adjust the lock for being operated by a key different from the key to which the lock was formerly adapted.

This invention also concerns the use keys and the change keys having special characteristics in order to operate this lock. More particularly, the invention concerns improvements to a kind of programmable cylinder lock, which is known from EP 0.226.252 and EP 0.900.310. The documents US 2009/277239 and US 2005/217330 are also of interest.

In a usual cylinder lock, which comprises a stator and a cylindrical rotor mounted inside the stator, rotatable around its own axis and having a keyhole extending along the direction of the axis for insertion of a key, a number of locking pins is mounted in the rotor, movable perpendicularly to the axis on the extension of the keyhole plane, and each locking pin is intended to cooperate with a section of the key, whose codification is represented by the level of a tooth or recess of the key which is situated in the considered key section. The length of each locking pin is such that, when it cooperates with the corresponding section of the correct key, its distal end portion corresponds to the cylindrical rotor surface and does not hinder its rotation, whereby, when all the locking pins are displaced in their respective correct positions by the correct key, the rotor can be rotated for operating the lock. When, on the contrary, one or more locking pins are not in their correct positions, they (or counterpins which may be provided in the stator) extend through the cylindrical rotor surface and hinder the rotation thereof and therefore the operation of the lock. Because the lock codification is represented by the lengths of the locking pins, and is established during the manufacture, the lock can be operated by only one correct key, and it cannot be programmed.

The programmable locks of the kind to which applies the present invention and which are described in the cited documents comprise, within a rotor rotatably mounted inside the stator, instead of locking pins having preestablished lengths, a number of key followers movable along their longitudinal and transversal directions, intended to cooperate with the codification conformations of a key inserted into the rotor keyhole, and locking pins having longitudinal movability which are the blocking members of the lock. The key followers and the locking pins form pairs each comprising a locking pin and a key follower, and the locking pins and key followers are provided with toothings intended to mutually cooperate, in different relative positions, for determining the lock codification. A transversally displaceable stop bar, cooperating with a longitudinal stator groove and having projections suitable for cooperating with recesses of the locking pins, is intended to immobilize the locking pins when the rotor is rotated within the stator and, as a consequence, the stop bar comes out of said groove and engages the locking pins. A transversally displaceable change bar is slidably engaged with the key followers and normally retains the same engaged with the locking pins, but this change bar, when it enters said stator groove, transversally displaces the key followers by disengaging the same from the locking pins, thus allowing the modification of the lock codification by replacing the former key by a new different key.

In a lock of this kind, during the rotation of the rotor for operating the lock, the rotor passes through the change position, and then the key followers are momentarily disengaged from the locking pins. If, though not being desired a change, in this position the key is extracted or displaced, the lock codification is lost or modified. For this reason there are known different protection systems intended to hinder the extraction or the displacement of the key when a change is not required. However, in the change position of the rotor the engagement between the key followers and the locking pins is missing and therefore, even in the presence of such protection systems, the lock codification might be modified or adulterated by rendering the same less precise, by accidental causes, such as clearances, a key wear or other grounds. Therefore, the known protection systems are not entirely effective.

SUMMARY OF THE INVENTION

The main object of this invention is to improve a lock of the considered kind in order to make up for the stated drawback, by preventing in a certain manner any modification of the lock codification when the rotor is situated in the change position, in the case that the change operation is not deliberately required by the user.

The idea on which is based the invention is to prevent the disengagement between key followers and locking pins in the change position, when the lock is operated by a normal use key and not by a special change key.

This object is attained, according to the invention, in a lock of the stated kind, in that at least one of the key followers is provided, on the side opposed to the change bar, with a projection which engages a side surface of the key, and which prevents the transversal displacement of the key follower and of the change bar when the projection contacts a normal use key having its side surface situated in a determined position, whereas said projection, when contacting a special change key having its side surface situated in a position different, allows the transversal displacement of the key follower and of the change bar, and therefore the disengagement between all the key followers and locking pins of the lock.

In this way, the protection against the displacement or extraction of the use key in the change position is obtained as in the known systems, but in addition there is also prevented any accidental modification or alteration of the lock codification when the rotor, operated by a use key, passes through the change position.

Preferably, for reasons of resistance and of constructive unification, said projection is provided on a number of key followers or, more preferably, on all the key followers of the lock.

The use keys and the change keys intended to operate the lock according to the invention are characterized in that they have a side surface located in different positions for the use keys and for the change keys.

In a preferred embodiment, said different positions of a side surface of the use keys and the change keys is obtained by giving to a key portion a thickness which differs between the use keys and the change keys.

BRIEF DESCRIPTION OF THE DRAWINGS

These and other features, objects and advantages of the subject of the present invention will more clearly appear from the following description of a preferred embodiment, being a not limiting example, with reference to the accompanying drawings, wherein.

DESCRIPTION OF THE PREFERRED EMBODIMENTS

Figure 1:
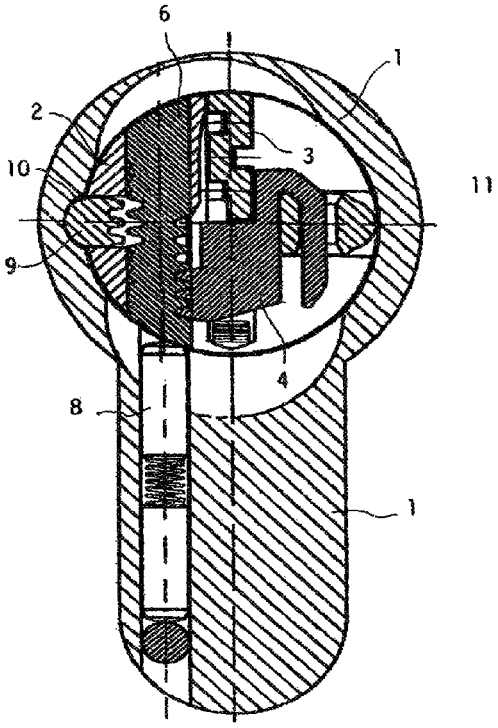
FIG. 1 PRIOR ART
FIG. 1 represents, for the purpose of reference, a cross section of a programmable cylinder lock known from the European Patent No. 0.900.310, shown in a condition of normal operation.

At first, reference to FIGS. 1 and 2 will be made in order to recall the general structure and the operation of a lock of the considered kind, for whose particulars reference is made to the cited documents.

Number 1 designates a stator inside which there is rotatably mounted a cylindrical rotor 2 having an axial keyhole susceptible of receiving a key 3. In the following, it will be considered as longitudinal the direction parallel to the axis of rotor 2 and the plane of the keyhole, and will be considered as transversal the direction perpendicular to the plane of the key and of the keyhole.

In rotor 2 there are mounted key followers 4, which lie in a plane perpendicular to the axis of the cylindrical rotor 2 and are movable along the longitudinal and transversal directions. The key followers 4 are provided for cooperating with the codification conformations of key 3. Moreover, in rotor 2 there are mounted locking pins 6, and each of them is coplanar with a key follower 4 and is movable along its own longitudinal direction. In the represented case the locking pins 6 cooperate with counterpins 8, and along with them they form the blocking members of the lock.

The key followers 4 and the locking pins 6 have toothings intended to mutually cooperate, and this cooperation may take place in different relative positions in order to define the lock codification. A stop bar 9, displaceable in the transversal direction within rotor 2 and susceptible of cooperating with a groove 10 of stator 1, serves for immobilizing the locking pins 6 when rotor 2 is made to rotate within stator 1 and, as a consequence, the stop bar 9 comes out of said groove 10 and engages the locking pins 6.

Figure 2:
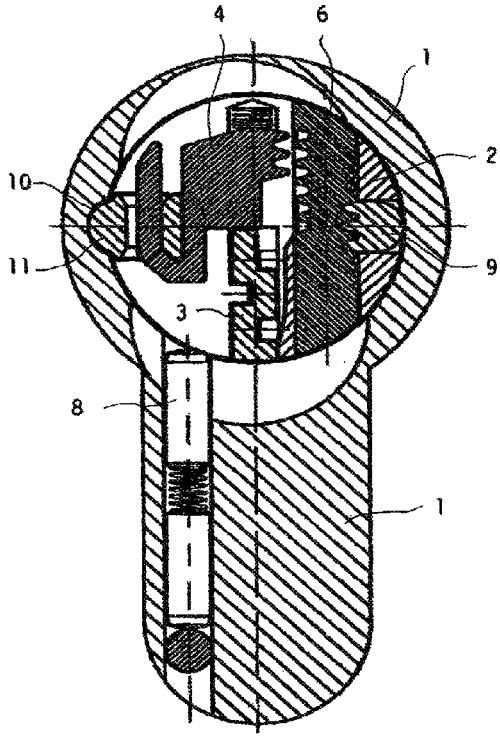
FIG. 2 PRIOR ART
FIG. 2 shows a cross section corresponding to that of FIG. 1, but the lock being in a change condition.

A change bar 11 which is transversally displaceable in rotor 2 is slidingly coupled with the key followers 4, and normally the change bar 11 keeps the key followers 4 engaged with the locking pins 6 as shown by FIG. 1 but, when said change bar 11, due to a rotation of rotor 2, comes to correspond to said groove 10 of stator 1 and enters therein, it transversally displaces the key followers 4 and disengages the same from the locking pins 6, as shown by FIG. 2. Then, by means of the replacement of the former key 3 by a different key, it is possible to modify the lock codification.

The condition represented in FIG. 2 takes place, in the known locks, not only when a codification change is required, but every time the rotor 2, during its rotation, passes through the position in which the change bar 11 corresponds to the groove 10 of stator 1 and penetrates therein. As a consequence of this fact there are encountered the above cited drawbacks.

Figure 3:
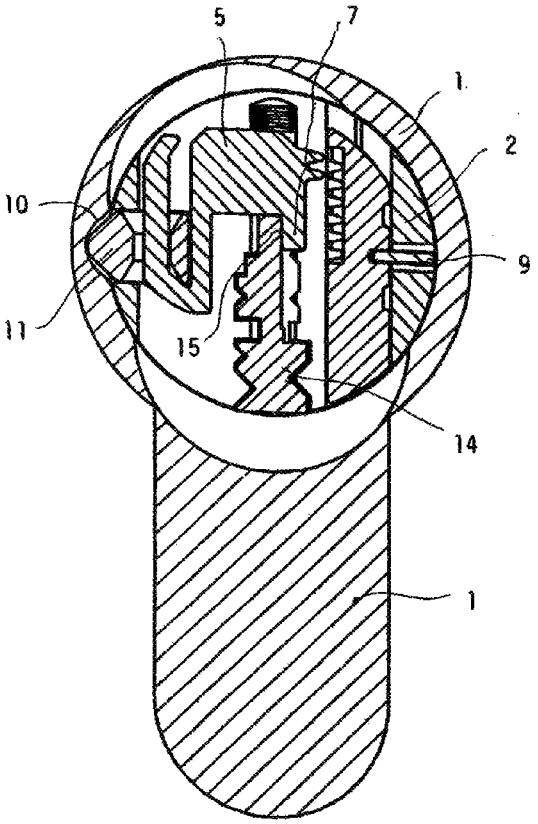
FIG. 3 shows a cross section of a lock according to the invention, in a condition corresponding to that of FIG. 2.
Figure 4:
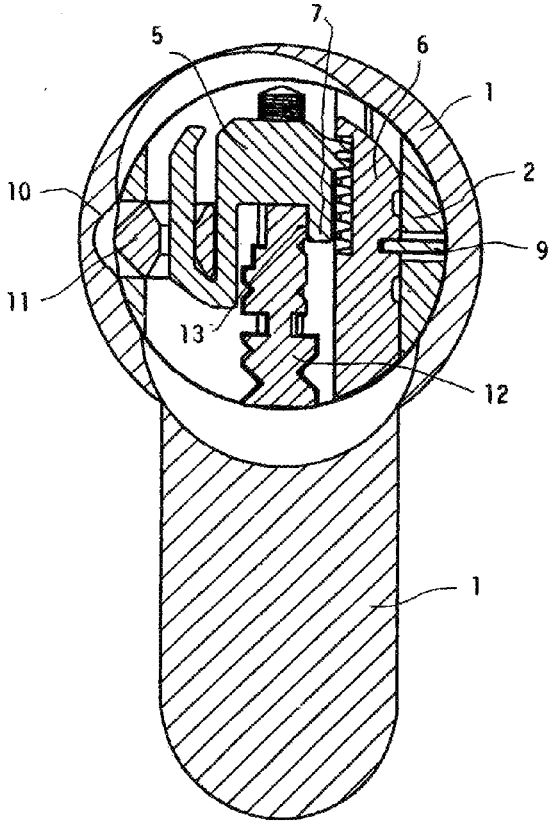
FIG. 4 shows a cross section corresponding to that of FIG. 3, but in a special lock condition obtained thanks to the application of the invention.

In FIGS. 3 and 4, which refer to the lock according to the invention, the component parts corresponding to those of FIGS. 1 and 2 are designated by the same references, and they will not be further described. In what concerns the normal operation, out of the change position, the lock according to the invention does in no way differ from the known locks.

The main difference of the lock according to FIGS. 3 and 4 with respect to the known lock according to FIGS. 1 and 2 is that the key followers, here designated by the reference 5, are provided on the side opposite the change bar 11 with a projection 7. This projection 7 engages the side of key 12 or 14 inserted into the lock.

Figure 6:
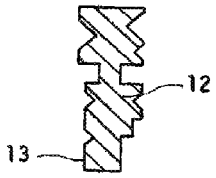
FIG. 6 shows on a larger scale a cross section of the use key, taken along line VI-VI of FIG. 5.
Figure 5:
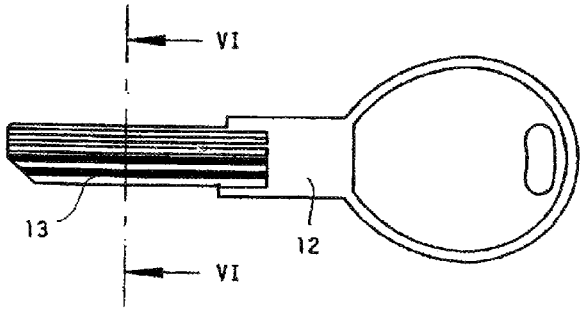
FIG. 5 shows a use key suitable for being used with the lock according to the invention.

The use key 12 represented in FIGS. 5 and 6, when it is inserted in the lock, has the outer surface 13 of one of its sections contacting the projection 7 of the key follower 5, and this outer surface 13 of the use key 12 has such a position that, due to the rest of projection 7 against the surface 13 of key 12, the key follower 5 cannot displace in the transversal direction and, therefore, it also retains the change bar 11. Therefore this latter, even when it is placed in correspondence of groove 10, cannot enter therein.

As shown by FIG. 4, the key follower 5 remains engaged with the locking pin 6, and in the same manner all the key followers 5 of the lock remain engaged with the corresponding locking pins 6. The codification of the lock cannot be in any way altered. At the same time, the engagement of the key followers 5 with the locking pins 6 prevents the key followers 5 from displacing in the longitudinal direction, so that the use key 12 cannot be extracted nor displaced. Therefore, the change protection is obtained in a complete manner.

Figure 8:
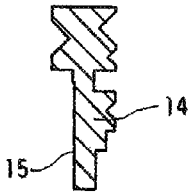
FIG. 8 shows on a larger scale a cross section of the change key, taken along line VIII-VIII of FIG. 7.
Figure 7:
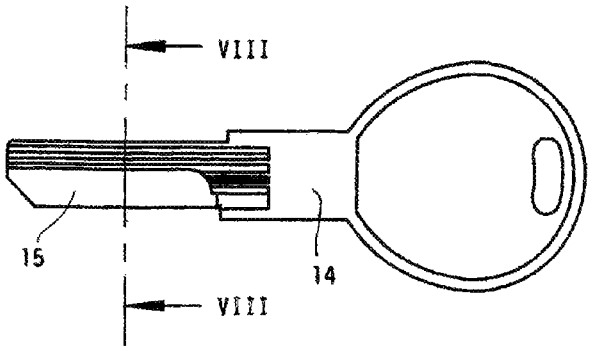
FIG. 7 shows a change key suitable for being used with the lock according to the invention.

On the contrary the change key 14, represented in FIGS. 7 and 8, has an outer surface 15 (corresponding to the outer surface 13 of the use key 12) located in a retracted position with respect to the position of the outer surface 13 of the use key. For example, as in the embodiment shown, this is due to a portion of the change key 14 having a thickness lower than the thickness of the corresponding portion of the use key 12. Therefore the key follower 5 is free to displace in the transversal direction and does not retain the change bar 11. This latter, therefore, when it is located in correspondence with groove 10, enters therein. As shown by FIG. 3, the key follower 6 disengages from the locking pin 6 and, in the same manner, all the key followers 5 of the lock disengage from the corresponding locking pins 6. The former codification of the lock is thus deleted. At the same time, the disengagement of the key followers 5 from the locking pins 6 allows the key followers 5 to displace in the longitudinal direction, whereby the change key may be extracted and replaced by a different change key in order to codify the lock in a manner different from the former one.

Thanks to the application of the invention there is obtained by simple and sure means a complete safety of the precise retainment of the codification as long as the lock is operated by use keys only, and this also in the case of a wrong maneuver of the user or in the presence of any accidental action, whereas the modification of the codification is very easy by using change keys.

It is easily understood that, in order to attain the behavior foreseen by the invention, it is sufficient that a single key follower of the lock has the described features. However it is preferred that a number of key followers, or more preferably all the key followers of the lock, are provided with the described features.

The characteristics of the invention may be applied to the locks of the stated kind, irrespective of the fact that they foresee or not the presence of master keys.

It is to be understood that this invention is not limited to the embodiment described and shown as an example. Several possible modifications have been pointed out in the course of the description, and others are within the ability of those skilled in the art. These modification and others, and any replacement by technically equivalent means, can be made to what has been described and shown, without departing from the scope of this Patent as defined by the appended claims.

The invention claimed is:

1. A system including a programmable cylinder lock and keys therefor, the programmable cylinder lock comprising:

a stator;

a cylindrical rotor mounted inside the stator for rotation about an axis, said rotor having a keyhole extending along the axis for insertion of a key;

a plurality of key followers inside said rotor, movable along longitudinal and transverse directions, configured to cooperate with codification conformations of a key inserted into the keyhole of said rotor; and a plurality of locking pins inside said rotor, movable along a longitudinal direction of the locking pins, which form lock blocking members;

wherein said key followers and said locking pins have teeth and form together a plurality of pairs each including a locking pin and a key follower that are configured to mutually cooperate, in different relative positions, in order to define a lock codification, the rotor further comprising:

a transversely displaceable stop bar configured to cooperate with a longitudinal groove of said stator and configured to, when said rotor rotates within said stator, come out of said groove and engage and immobilize said locking pins; and a change bar that is transversely displaceable and is slidingly coupled with said key followers to keep the key followers engaged with the locking pins when said change bar is not in said groove of the stator, and to disengage the key followers from the locking pins when said change bar takes a lock programming position by entering said groove of the stator;

wherein at least one of the key followers comprises a projection opposite the change bar, configured to engage a side surface of a key and, upon contact of a normal use key with a side surface situated in a determined position, to prevent transverse displacement of the key follower and the change bar, and thereby to prevent disengagement of the key followers from the locking pins, and wherein said projection, upon contact of a special change key with a corresponding side surface situated in a different position, is configured to allow transverse displacement of the key follower and the change bar, and thereby to allow disengagement of all key followers from the locking pins of the lock.

2. The system according to claim 1, wherein each of a plurality of said key followers of said programmable cylinder lock comprises a respective said projection.

3. The system according to claim 1, wherein each of said key followers of said programmable cylinder lock comprises a respective said projection.

4. The system according to claim 1, wherein, in at least one position along a blade of each of said use and change keys, a side surface of the use key is in a different position from a side surface of the change key.

5. The system according to claim 4, wherein the different position of said side surface of the use key and said side surface of the change key is obtained by imparting to a portion of each key a thickness that is different for the use key than for the change key.

* * * * *